US011459717B2

(12) United States Patent
Côté et al.

(10) Patent No.: US 11,459,717 B2
(45) Date of Patent: Oct. 4, 2022

(54) SNOW PLOW EXTENSION SLIDE

(71) Applicant: 9091-4532 Québec inc., L'Isle-Verte (CA)

(72) Inventors: Etienne Côté, L'Isle-Verte (CA); Alexandre Côté, L'Isle-Verte (CA)

(73) Assignee: 9091-4532 QUÉBEC INC., L'Isle-Verte (CA)

( * ) Notice: Subject to any disclaimer, the term of this patent is extended or adjusted under 35 U.S.C. 154(b) by 267 days.

(21) Appl. No.: 16/719,438

(22) Filed: Dec. 18, 2019

(65) Prior Publication Data

US 2021/0189672 A1 Jun. 24, 2021

(51) Int. Cl.
*E01H 5/06* (2006.01)

(52) U.S. Cl.
CPC ..... *E01H 5/061* (2013.01)

(58) Field of Classification Search
CPC ..... E02F 3/15; E02F 3/76
See application file for complete search history.

(56) References Cited

U.S. PATENT DOCUMENTS 4,275,514 A * 6/1981 Maura ..... E01H 5/065 37/281
4,667,426 A * 5/1987 Howard ..... E01H 5/065 172/816
5,392,538 A * 2/1995 Geerligs ..... E01H 5/061 37/236
5,411,102 A * 5/1995 Nickels ..... A01B 59/044 172/247
6,408,549 B1 * 6/2002 Quenzi ..... E01H 5/065 37/281
6,412,199 B1 * 7/2002 Quenzi ..... E01H 5/065 37/281
6,442,877 B1 * 9/2002 Quenzi ..... E01H 5/065 37/281
6,877,258 B2 * 4/2005 Frey ..... E01H 5/06 37/274
7,134,227 B2 * 11/2006 Quenzi ..... E01H 5/066 37/274
7,681,337 B2 * 3/2010 Watson ..... E01H 5/065 37/281
7,992,327 B2 * 8/2011 Gamble, II ..... E02F 3/627 37/232
8,607,482 B2 * 12/2013 Bloxdorf ..... E01H 5/065 37/274
8,850,724 B2 * 10/2014 Bloxdorf ..... E01H 5/067 37/283
10,106,942 B2 * 10/2018 Roberge ..... E01H 5/061
2015/0040441 A1 * 2/2015 Nammensma ..... E01H 5/065 29/428

FOREIGN PATENT DOCUMENTS

GB 2491202 A * 11/2012 ..... E02F 3/8155

* cited by examiner

*Primary Examiner* — Jessica H Lutz
(74) *Attorney, Agent, or Firm* — Benoit & Cote Inc.; Mathieu Audet

(57) ABSTRACT

A snow plow blade assembly comprises a main blade, an extension blade extending laterally from the main blade; a slide member and a flat bar. An interface is present between the main blade and the extension blade, with the slide member and the flat bar installed at the interface. The slide member slidably cooperates with the flat bar to control or to minimize a gap between the main blade and the extension blade at the interface.

15 Claims, 10 Drawing Sheets

SNOW PLOW EXTENSION SLIDE

BACKGROUND

(a) Field

The present invention generally relates to blades for snow plows, graders and the like and, more particularly, is concerned with an assembly for extendable snow plow blades assembly that provides improved cooperation between the central part and the extension parts of the snow plow blade assembly.

(b) Related Prior Art

Graders and snow plows are both well-known and each have a relatively long moldboard which extends generally laterally of the surface being worked and is moved over the surface in a direction generally perpendicular to the length of the moldboard. It is conventional practice to mount a blade on the lower edge of such moldboard with the blade, in turn, extending downwardly below the moldboard lower edge and itself having a lower edge forming the working surface of the blade.

Some graders and snow plow blades are extendable blade assemblies comprising two or more parts moving relatively to each other to provide a blade having an adjustable width. However, these blade assemblies comprising more than one part have drawbacks such as less rigidity, vibration problems and a tendency for graded material to accumulate in parts of the blade assembly.

There is therefore a need for an improved extendable blade assembly for snow plows and graders that better respond to these drawbacks.

SUMMARY

According to an embodiment, there is provided a snow plow blade assembly for plowing material on a ground, the snow plow blade assembly comprising: a main blade; an extension blade extending laterally from the main blade; an interface between the main blade and the extension blade near the ground; a slide member; a straight bar; wherein slide member and the straight bar are at the interface, and wherein the slide member slidably cooperates with the straight bar as the main blade and the extension blade move relative to each other.

According to an aspect, the main blade comprises a longitudinal bottom edge and the extension blade comprises a longitudinal bottom edge and further wherein the interface is at the longitudinal bottom edges; whereby the slidable cooperation of the slide member with the straight bar contributes to at least one of: a reduction of vibration of the main blade and the extension blade during operation; an increase in a rigidity of the assembly of the main blade and the extension blade; a reduction of a gap between the main blade and the extension blade at the interface; and a reduction of an accumulation of material in or to the blade assembly.

According to an aspect, a gap exists between the main blade and the extension blade at the interface further comprising a glide pad installed in the gap to reduce and to further minimize the gap between the main blade and the extension blade at the interface.

According to an aspect, the glide pad is installed between the slide member and the main blade.

According to an aspect, the slide member comprises an extension lip which cooperates with the straight bar to minimize the gap between the main blade and the extension blade at the interface.

According to an aspect, the slide member is L-shaped.

According to an aspect, the straight bar comprises a top edge, wherein the slide member is installed on the extension blade above the top edge with the extension lip extending beyond and below the top edge and distant from the extension blade to minimize relative movement of the straight bar between the extension blade and the slide member.

According to an aspect, the slide member is installed on the extension blade and the straight bar is installed on the main blade.

According to an aspect, the main blade has a longitudinal bottom edge, and wherein the snow plow blade assembly comprises a main scraper blade extending from the longitudinal bottom edge of the main blade with the straight bar and the main scraper blade being mounted together to the main blade.

According to an aspect, the snow plow blade assembly further comprises a main scraper blade and an extension scraper blade, wherein the main blade and the extension blade each respectively comprise a longitudinal bottom edge, wherein the main scraper blade extends from the longitudinal bottom edge of the main blade and the extension scraper blade extends from the longitudinal bottom edge of the extension blade.

According to an aspect, the snow plow blade assembly further comprises an other glide pad installed between the main scraper blade and the extension scraper blade.

According to an aspect, the other glide pad is attached to the main scraper blade.

According to an aspect, the main blade comprises holder assemblies for mounting the snow plow blade assembly to a snow plow, with the main blade being stationary and the extension blade being mobile with respect to the snow plow.

According to an embodiment, there is provided a snow plow blade assembly for plowing material, the snow plow blade assembly comprising: a main blade; an extension blade, wherein the main blade and the extension blade are extendable laterally from each other; a straight bar comprising an edge and being mounted to the main blade; and an interface between the main blade and the extension blade comprising a groove on the extension blade slidably housing the edge of the straight bar; wherein the straight bar slides in the groove as the main blade and the extension blade move relative to each other.

According to an aspect, the interface further comprises an other groove, wherein the groove and other groove are distant from and parallel to each other.

According to an aspect, the interface comprises a glide pad installed in a gap at the interface between the main blade and the extension blade to reduce and to minimize the gap between the main blade and the extension blade at the interface.

According to an aspect, the main blade and the extension blade each have a horizontal area interfacing with each other, and wherein the interface comprises a glide pad about either one of the horizontal areas.

According to an aspect, the main blade and the extension blade have a top edge and wherein the interface comprises an other groove located on one of the main blade and the extension blade with one of the top edges being slidably housed in the other groove.

According to an aspect, the snow plow blade assembly further comprises a slide member comprising an extension lip which cooperates with the extension blade to define the groove minimizing a gap between the main blade and the extension blade at the interface.

According to an aspect, the slide member is installed on the extension blade above the edge of the straight bar with the extension lip extending beyond and below the edge of the straight bar and distant from the extension blade to minimize relative movements of the straight bar between the extension blade and the slide member.

Some of the advantages of the snow plow blade assemblies described herein include, but are not limited to, increasing rigidity of the assembly of the main blade and the extension blade, reducing vibration problems when the snow plow blade assembly is in use (in the forward direction or backward direction) and avoiding the accumulation of graded material in parts of the blade assembly.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
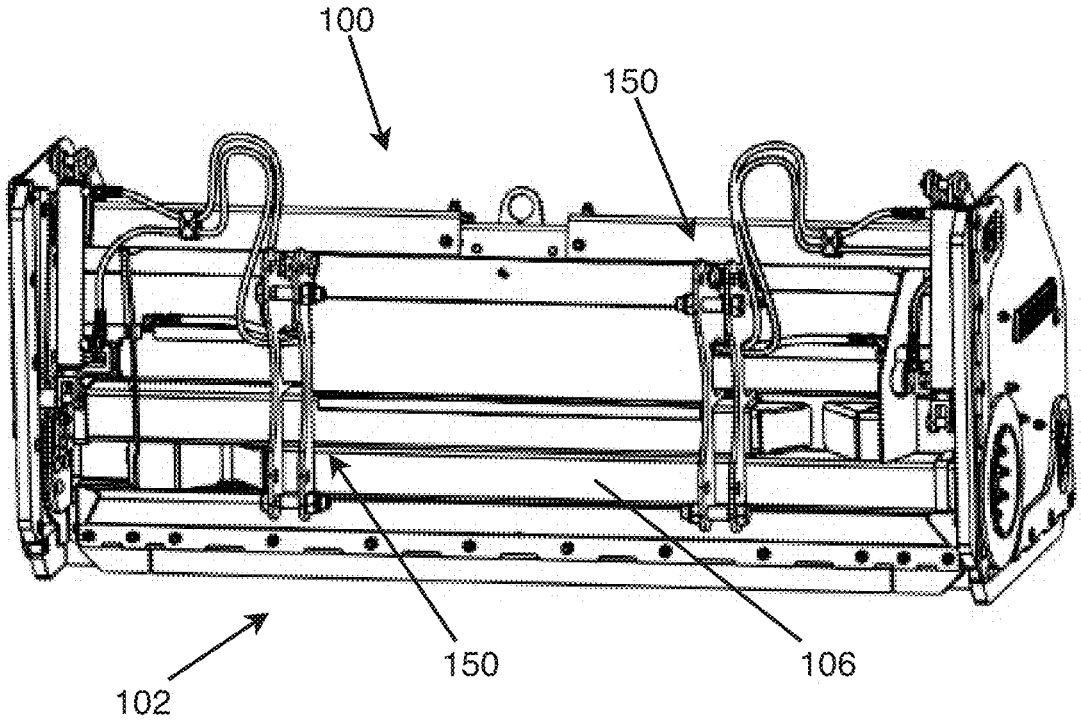
FIG. 1 is a perspective view of the rear face of an extendable snow plow blade assembly in accordance with an embodiment with some components of the hydraulic system missing.

The realizations will now be described more fully hereinafter with reference to the accompanying figures, in which realizations are illustrated. The foregoing may, however, be embodied in many different forms and should not be construed as limited to the illustrated realizations set forth herein.

With respect to the present description, references to items in the singular should be understood to include items in the plural, and vice versa, unless explicitly stated otherwise or clear from the text. Grammatical conjunctions are intended to express any and all disjunctive and conjunctive combinations of conjoined clauses, sentences, words, and the like, unless otherwise stated or clear from the context. Thus, the term "or" should generally be understood to mean "and/or" and so forth.

Recitation of ranges of values and of values herein or on the drawings are not intended to be limiting, referring instead individually to any and all values falling within the range, unless otherwise indicated herein, and each separate value within such a range is incorporated into the specification as if it were individually recited herein. The words "about," "approximately," or the like, when accompanying a numerical value, are to be construed as indicating a deviation as would be appreciated by one of ordinary skill in the art to operate satisfactorily for an intended purpose. Ranges of values and/or numeric values are provided herein as examples only, and do not constitute a limitation on the scope of the described realizations. The use of any and all examples, or exemplary language ("e.g.," "such as," or the like) provided herein, is intended merely to better illuminate the exemplary realizations and does not pose a limitation on the scope of the realizations. No language in the specification should be construed as indicating any unclaimed element as essential to the practice of the realizations.

In the following description, it is understood that terms such as "first", "second", "top", "bottom", "above", "below", and the like, are words of convenience and are not to be construed as limiting terms.

The terms "top", "up", "upper", "bottom", "lower", "down", "vertical", "horizontal", "interior" and "exterior" and the like are intended to be construed in their normal meaning in relation with normal installation of the product, with indication of "front" referring to the same orientation as the snow plow on which would be mounted the present snow plow blade assembly.

In realizations, there are disclosed components of a snow plow and more particularly of a snow plow blade assembly 100, aka blade assembly 100.

Further, the general term "material", "plowed material" or "graded material" is used throughout the present document to describe what is pushed, pulled and more generally displaced by the snow plow or grader. One should thus understand that the term "material" refers generally to snow but is intended to encompass other types of materials one vehicle using the present blade assembly 100 may displace using the blade assembly 100.

It will be noted that throughout the appended drawings, like features are identified by like reference numerals.

Figure 2:
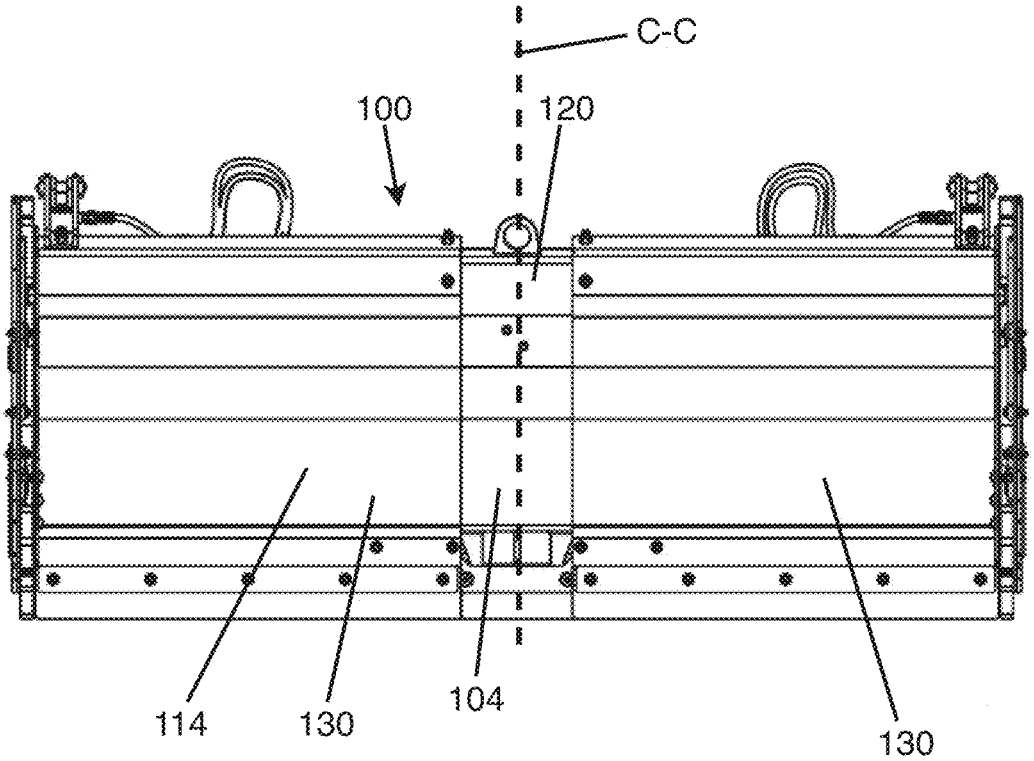
FIG. 2 is a front view of the blade assembly of FIG. 1.

Referring now to the drawings, and more particularly to FIGS. 1 and 2, a blade assembly 100 is adapted to be mounted to a snow plow, with the blade assembly 100 comprising on its rear wall 106 a pair of holder assemblies 150 adapted for the snow plow to hold the blade assembly 100.

The blade assembly 100 comprises a main blade 120 in its central portion and a pair of extension blades 130 mounted in a slidable manner to the main blade 120 in order to have a blade assembly 100 of adjustable width by sliding out or in the extension blades 130 relatively to the main blade 120. The extension blades 130 extend laterally from the main blade 120; the assembled blade assembly 100 forming a generally unitary assembly operating as a single blade.

Figure 3:
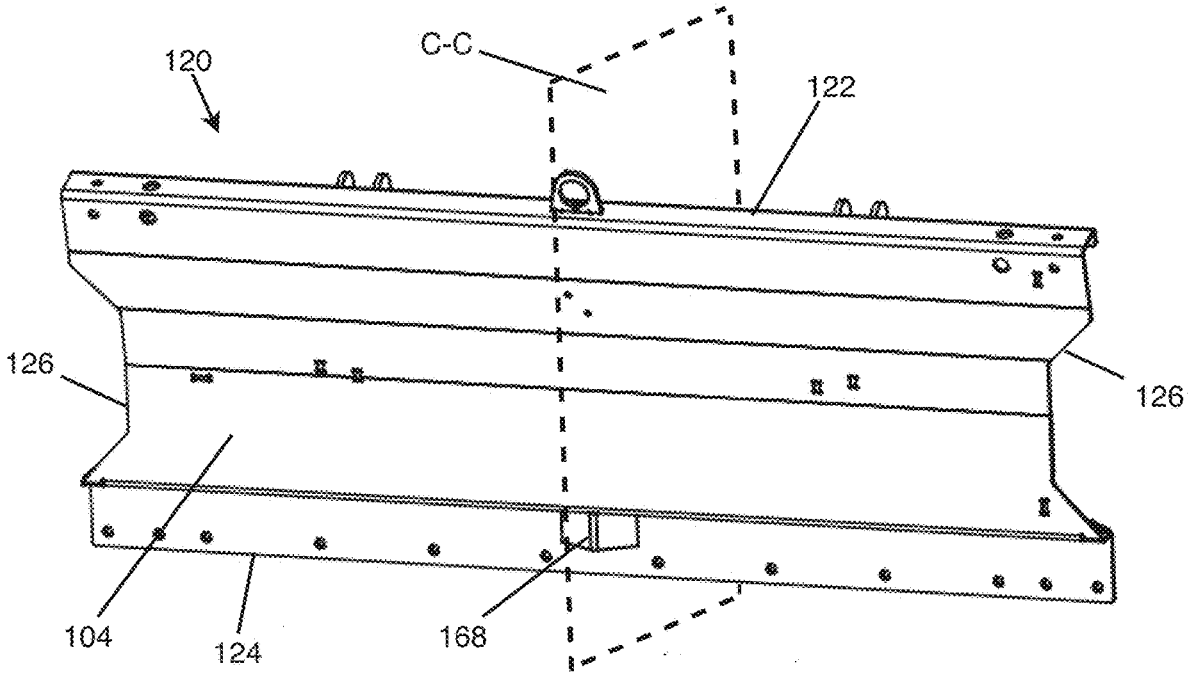
FIG. 3 is a perspective view of the front of the main blade of the blade assembly of FIG. 1.

Referring additionally to FIG. 3, the main blade 120 comprises a longitudinal top edge 122, a longitudinal bottom edge 124, and vertical side edges 126. The bottom edge 124 is intended to travel close to the ground and the side edges 126 are adapted to cooperate in a sliding manner with the extension blades 130. The holder assemblies 150 are mounted to the rear 102 of the main blade 120 for the holding configuration between the snow plow and the blade assembly 100 to remain constant regardless of the width of the blade assembly 100. The main blade 120 has a front wall 104 extending between its top edge 122 and its bottom edge 124 operating as a retaining wall able to push material.

Figure 4:
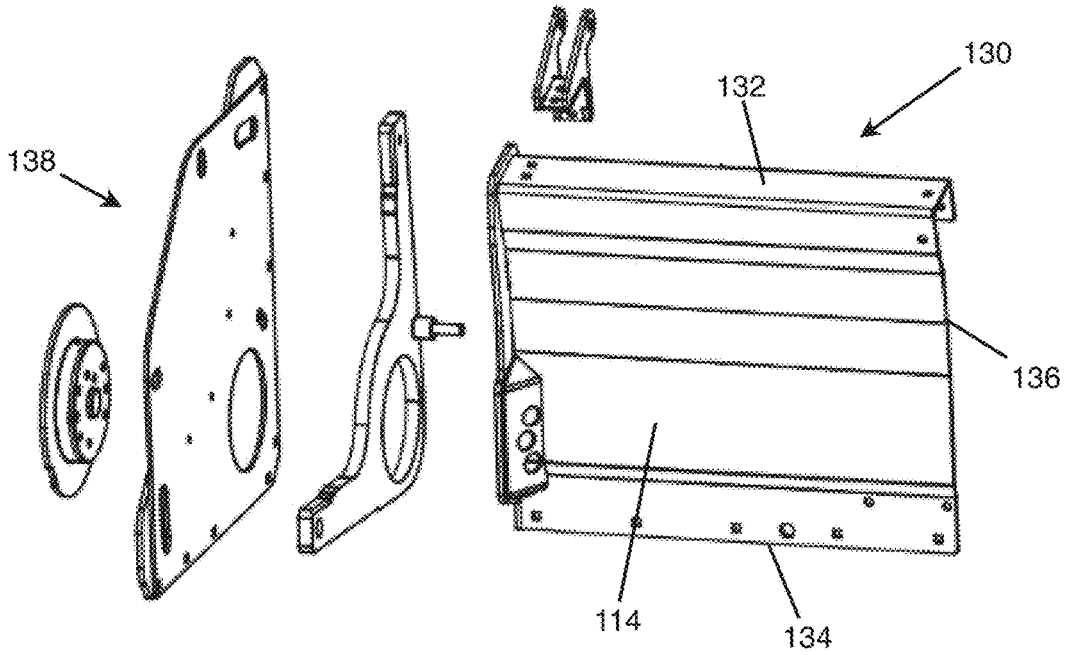
FIG. 4 is a perspective view of the front of one extension blade of the blade assembly of FIG. 1.

Referring additionally to FIG. 4, each of the extension blades 130 comprise a longitudinal top edge 132, a longitudinal bottom edge 134, and a vertical inner side edge 136. The inner side edge 136 is adapted to cooperate in a sliding manner with the main blade 120 as will be explained below. Each extension blade 130 has a front wall 114 extending between its top edge 132 and its bottom edge 134 operating as a retaining wall able to push material.

When mounted to each other, the extension blades 130 are mounted laterally to the main blade 120 as depicted on FIG. 2, the front wall 104 of the main blade 120 and the front wall 114 of each extension blade 130 operating together as a continuous front wall.

Further, once mounted to each other, the bottom edge 124 of the main blade 120 and the bottom edge 134 of each extension blade 130 extend substantially about the same horizontal plane, the combination defining a substantially continuous bottom edge.

Figure 5:
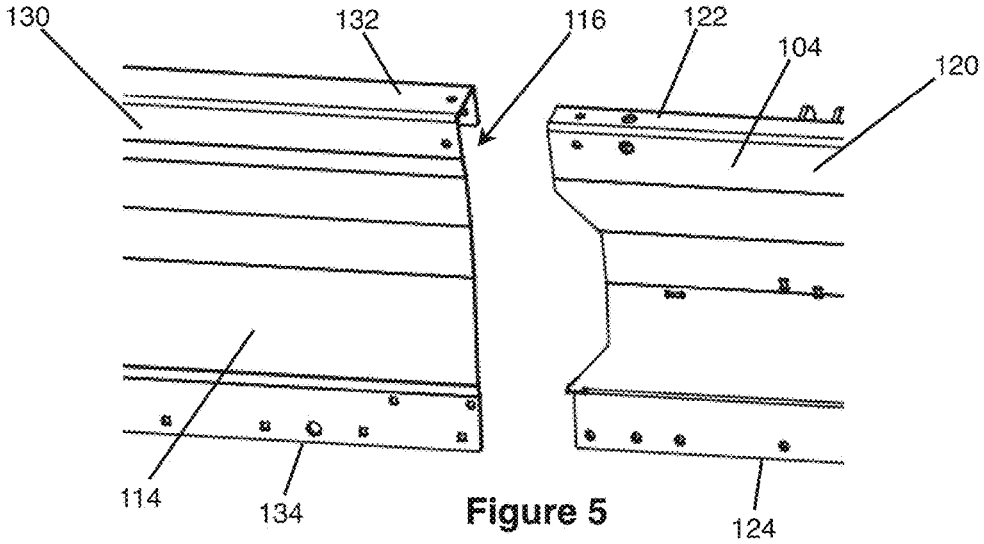
FIG. 5 is a perspective view of portions of the main blade and the extension blade of the blade assembly of FIG. 1 aside each other.

Referring additionally to FIG. 5, each extension blade 130 comprises a rear wall 116 having a shape that is complementary in some areas to the shape of the front wall 104 of the main blade 120 at its side edge 126. The complementary shapes allow the main blade 120 to mount in a partially inset manner relative to each of the extension blades 130. For example, the top edge 132 of each extension blade 130 has a C-shape where the complementary shaped top edge 122 of the main blade enters and slides when the extension blades 130 are mounted to the main blade 120. Another portion of each extension blade 130 and the main blade 120 located above the bottom edges 124, 134 are interfacing each other. These complementary shapes define an interface between the main blade 120 and the extension blades 130.

Each of the extension blades 130 comprises a side wall assembly 138 extending perpendicular to the front wall 114. The function of the side wall assembly 138 is to retain sideway the material when pushed by the blade assembly 100. With the left side and right side wall assemblies 138, the blade assembly provides a partially closed spaced limiting the migration of the material pushed by the blade assembly 100 on three sides: the inner face of the left side wall assembly 138, the front wall of the blade assembly 100 and the inner face of the right side wall assembly 138.

Figure 6:
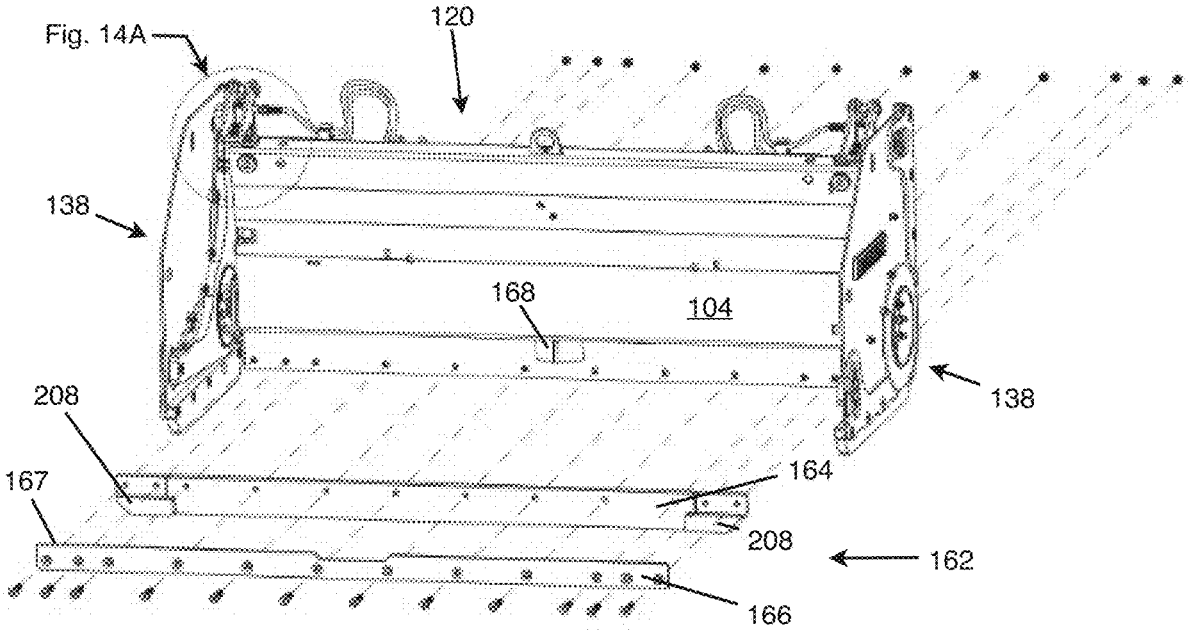
FIG. 6 is a partially exploded perspective view of the front of the blade assembly of FIG. 1, wherein the side wall assemblies are depicted autonomous, detached from the main blade.

Referring to FIG. 6 where is depicted a partially exploded perspective view of the front of the blade assembly 100 of FIG. 1, wherein the side wall assemblies 138 are depicted autonomous and detached from the main blade 120 (since intended to be mounted to the extension blades 130), the main blade 120 comprises a main scraper blade 162 removably mounted about the bottom of the front wall 104 and taking place slightly upfront of the front wall 104. In a snow plow realization, the main scraper blade 162 comprises a rubber blade 164 mounted to the front wall 104 with a straight bar 166 (aka. a main mounting plate), a longitudinal and straight flat bar, attached with bolts and nuts to the front wall 104, with the main scraper blade 162 defining the longitudinal bottom edge 124 of the main blade 120. Straight bar 166 comprises a straight top edge 167 which will be further discussed below. The blade assembly 100 further comprises a glide pad 208 mounted to the rubber blade 164. As will be shown in other figures, the glide pad 208 contributes to limit the vertical and horizontal movement of the extension blades 130 relative to the main blade 120.

Figure 7:
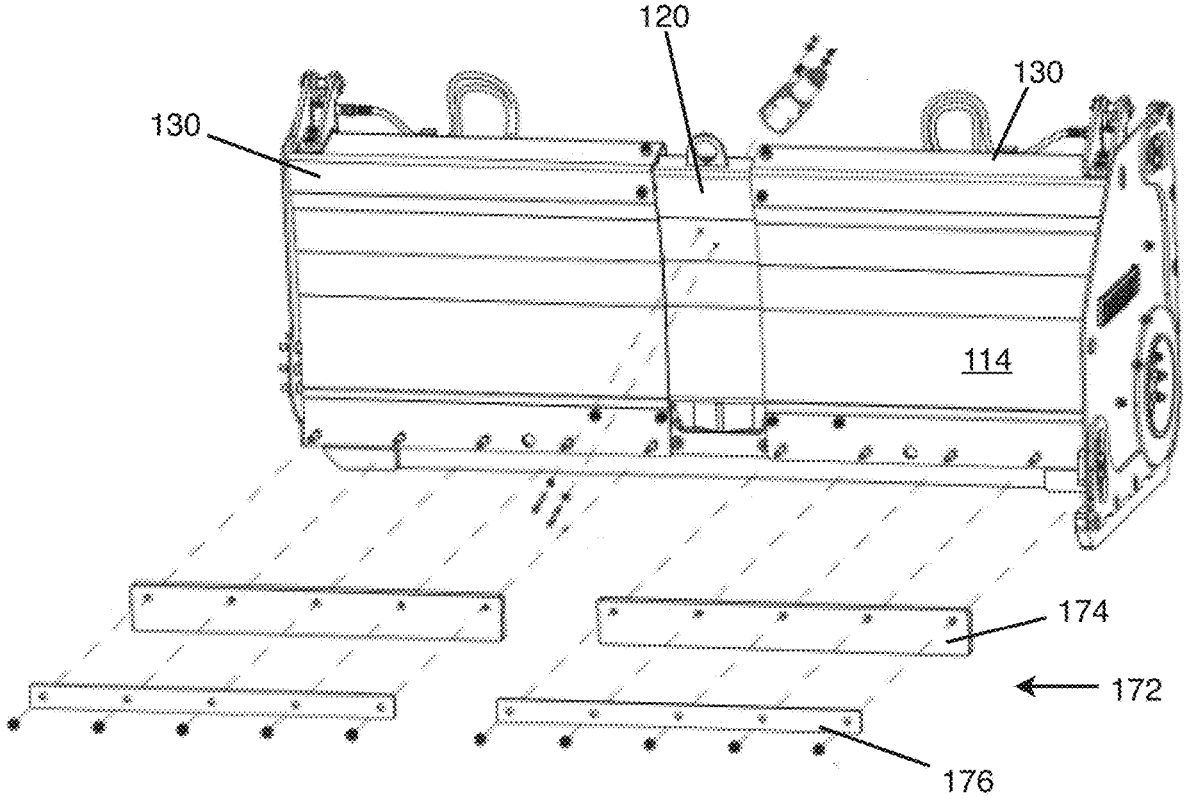
FIG. 7 is a partially exploded perspective view of the front of the blade assembly of FIG. 1 showing the main blade and the extensions blade with one missing side wall assembly.
Figure 8:
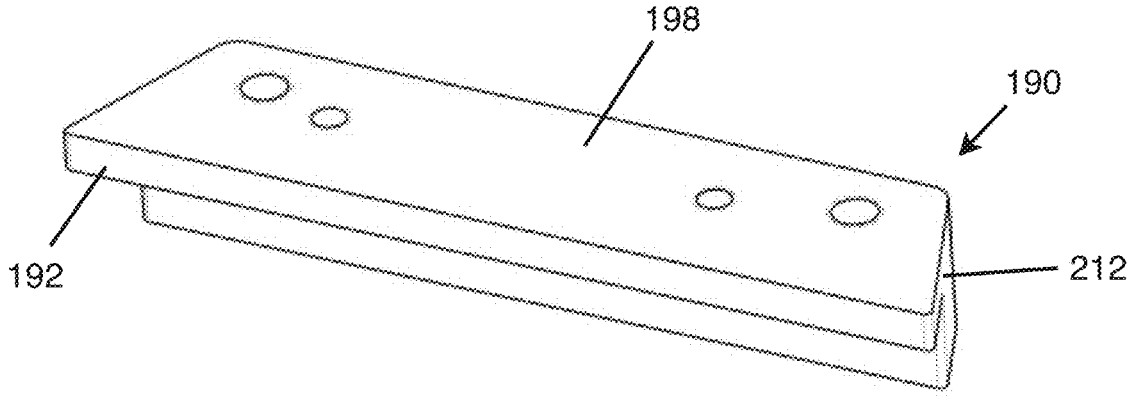
FIGS. 8 and 9 are perspective views of a rear face and a top face of a slide member in accordance with an embodiment forming part of the blade assembly of FIG. 1.
Figure 9:
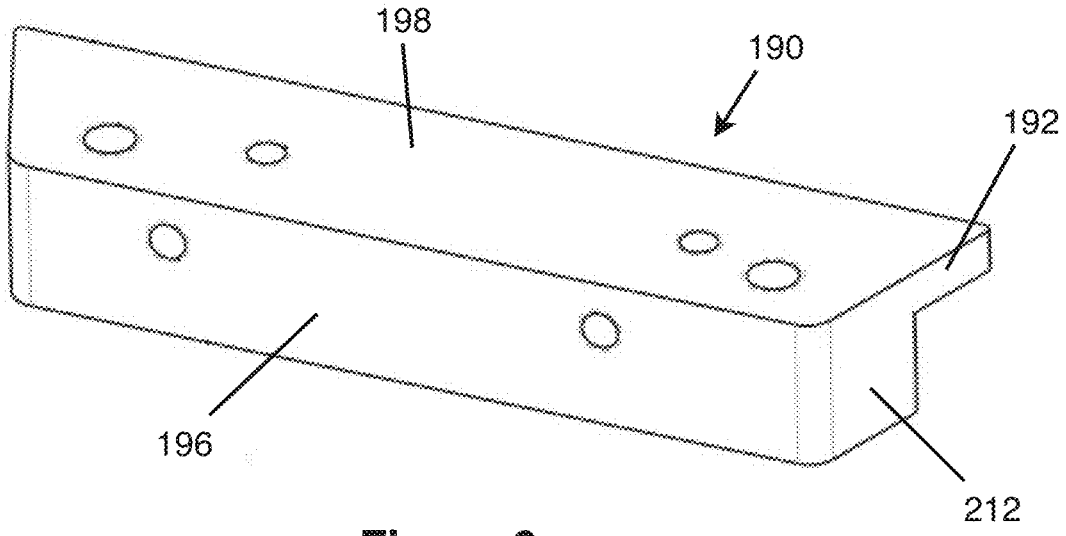
Figure 10:
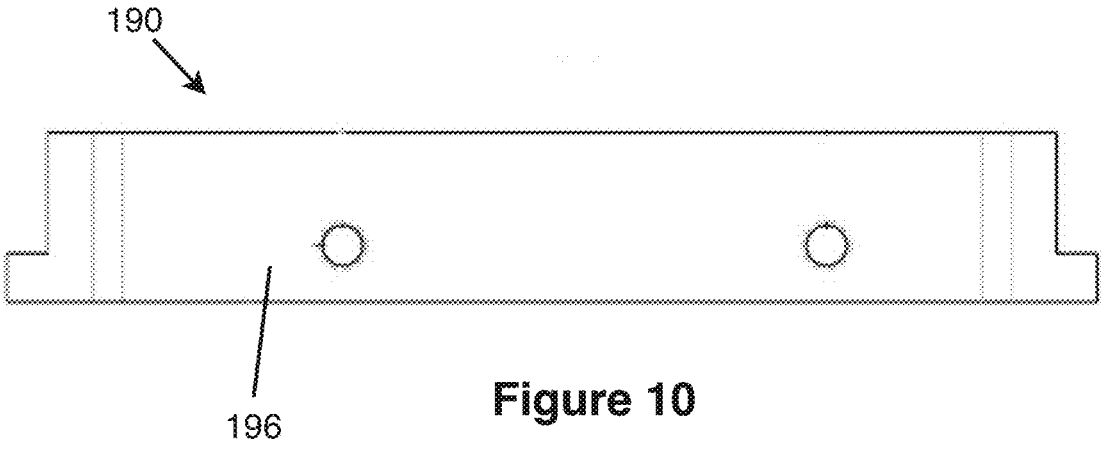
FIG. 10 is a view of the top face of the slide member of FIGS. 8 and 9.
Figure 11:
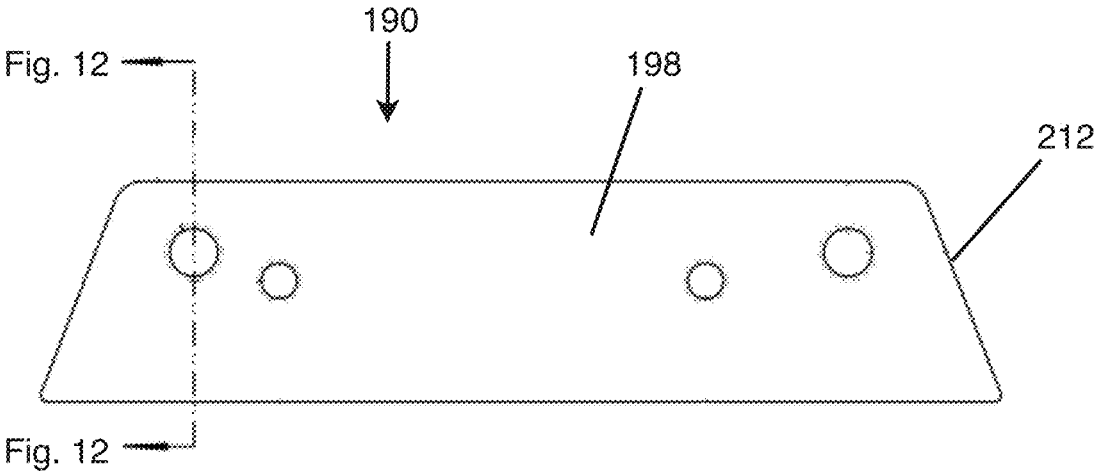
FIG. 11 is a view of the rear face of the slide member of FIGS. 8 and 9.
Figure 12:
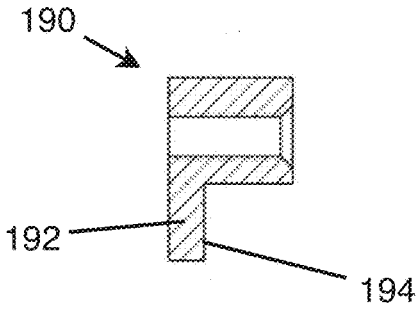
FIG. 12 is a cross-section view of the slide member of FIGS. 8 to 11 according to cutting line of FIG. 11.
Figure 13:
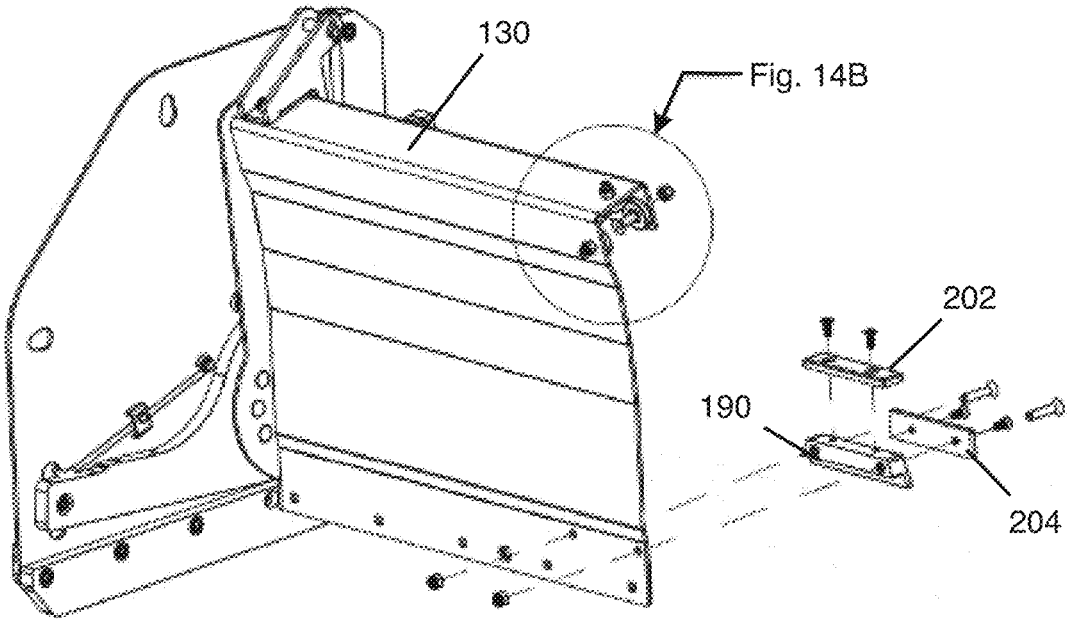
FIG. 13 is a partially exploded perspective view of the front of the extension blade, of the slide member, of glide pads and of a portion of the main blade.

Referring to FIG. 7, the extension blades 130 (with one illustrated without its side wall assembly 138) also comprise an extension scraper blade 172 removably mounted about the bottom of the front wall 114. In a snow plow realization, the extension scraper blade 172 comprises a rubber blade 174 mounted to the front wall 114 with a mounting plate 176 attached with bolts and nuts to the front wall 114 about the longitudinal bottom edge 134.

Referring back to FIGS. 2, 3 and 6, the main blade 120 has about its transversal vertical center line C-C (depicted on FIGS. 2 and 3) a fender 168 having a triangular profile with the base being at the front wall 104. The fender 168 is adapted to eject toward the front any material (e.g., snow and ice) pushed sideway toward it in cooperation with the slide member 190 (FIGS. 8 to 12) when decreasing the width of the blade assembly 100 as explained below.

It is worth noting that the main scraper blade 162 is mounted below the fender 168, providing clearance for the fender 168 to extend upfront of the main scraper blade 162 when projecting material frontward. Thereby, this design prevents the ejected material from sticking on the blade assembly 100 but rather to fall in front of the main scraper blade 162 to be moved with other material.

Referring now additionally to FIGS. 8 to 13 and 15 to 18, the blade assembly 100 comprises a slide member 190 mounted to each one of the extension blades 130 above the straight top edge 167 of the straight bar 166 (see FIG. 6). The top edge 167 itself extends higher than the top of the rubber blade 164 thereby creating a channel with the front wall 104 of main blade 120. The slide member 190 has a L-shape, thus defining a downward extension lip 192, with the inner rear face 194 (aka the inner face of the extension lip) and the rear wall 116 of the extension blade 130 defining a longitudinal groove housing the straight top edge 167 of the straight bar 166.

It should be noted that even though the slide member 190 is described as being located above the top edge 167 of the straight bar 166, it could also be located below the straight bar 166 with the extension lip 192 extending upward. Furthermore, it is also contemplated that the slide member 190 be installed on the main blade 120 while there would be a straight bar installed on each one of the extension blades 130.

Further, glide pads 202, 204 are mounted to the outer top face 196 and to the outer rear face 198 of the slide member 190. The glide pads 202, 204 thereby interface with the main blade 120 when the extension blade 130 is mounted to the main blade 120; the glide pads 202, 204 facilitating displacement of the extension blade 130 and the main blade 120 relative to each other.

Accordingly, with the groove hindering displacement of the straight bar 166 outside the orientation of the groove, and the glide pads 202, 204 taking place in the interface of the main blade 120 with the slide member 190 and thus preventing displacement of the extension blade 130 relative to the main blade 120 in the vertical direction and the horizontal direction other than in the orientation of the groove. The interface components of the blade assembly 100 ensure a constant cooperation between the main blade 120 and the extension blades 130 regardless of the width of the blade assembly 100. In other words, the gaps between the main blade 120 and the extension blade 130 at the interface are forced to remain constant over normal extensions of the extension blades 130 relative to the main blade 120. The gaps are thus minimized.

Figure 18:
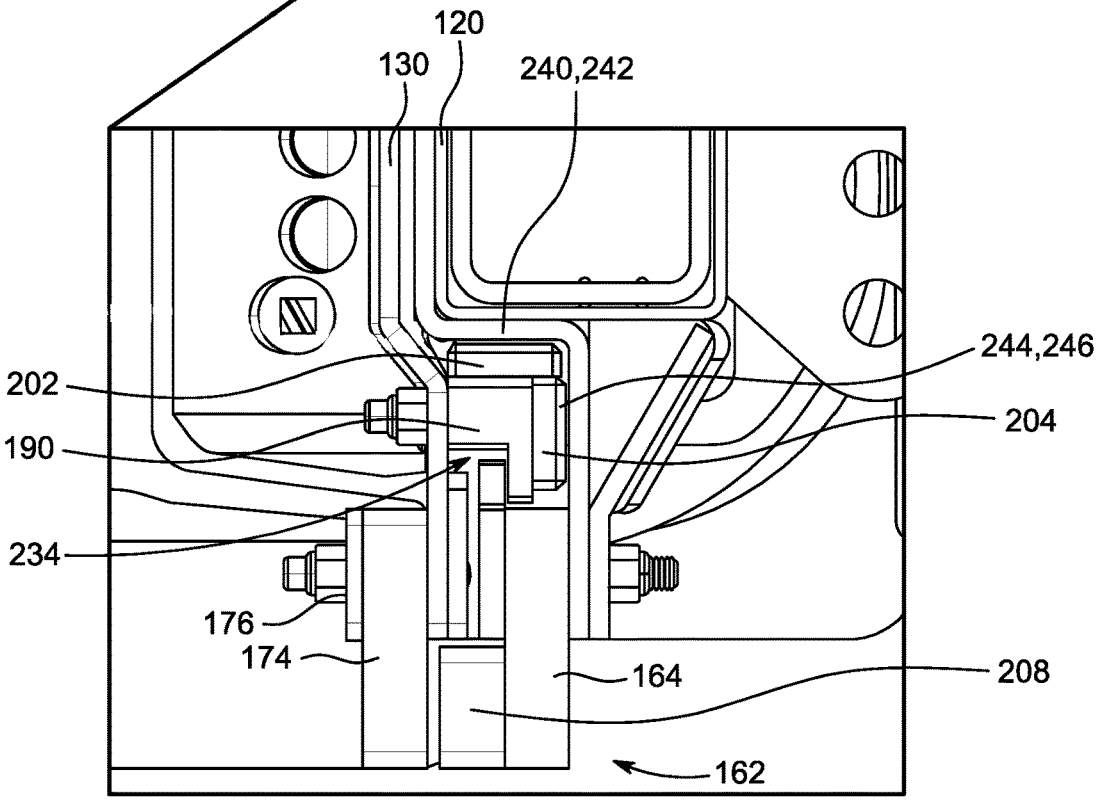
FIG. 18 is a close-up view of the sub-section of the blade assembly according to sub-section identification of FIG. 17.

Referring now particularly to FIG. 18, the blade assembly 100 comprises a glide pad 208 mounted to the rear wall 116 of the extension blade 130 below the slide member 190. The glide pad 208 limits the useable width of the groove formed by the slide member 190, the straight top edge of the mounting plate 176 being limited in its front and rear movement on the rear by the inner rear face 194 of the slide member 190 and on the front by the rear face of the glide pad 208.

Referring additionally to FIG. 6, the blade assembly 100 comprises, mounted about the extremities of the main blade 120, a pair of glide pads 208 mounted to the front of the main scraper blade 162, with each of the glide pads 208 filling the gap between the main blade 120 and the extension blade 130 about the side edges 126 (FIG. 3) of the main blade 120. The glide pads 208 help in maintaining the alignment of the extension blades 130 relative to the grooves defines by the slide members 190. Further, by filling the gap, the glide pads 208 help preventing any misalignment of the extension blades 130, distributing the pressure undergone by the extension blades 130 when pushing material. The gaps are thus further minimized.

It is worth noting that the slide members 190 are adapted to operate at any position between a narrow configuration (i.e., retracted position) and a widest configuration (i.e., extended position), thus the controllable width of the blade assembly 100 by controllably extending the extension blades 130 relative to the main blade 120 between the extended position and the retracted position.

The narrow configuration (i.e., retracted position) is when the inner side edges 138 of the extension blades 130 are about the center line C-C close to the fender 168. When the extension blades 130 move toward their retracted position, the side face 212 of the slide members 190 push material that may be lodged between the front wall 104, the main scraper blade 162 and the straight bar 166 toward the fender 168, with the material reaching the fender 168 being pushed forward by the sloped side face 212 provided by the triangular profile the fender 168. The side face 212 has a sloped profile for the material contacted by the side face 212 to be lifted out of the way, with the material remaining pushed by the side face 212 being pushed upfront of the main scraper blade 162 by the fender 168. It is to be noted that there is a reduction in the height of the straight bar 166 near the fender 168 thereby providing an exit passage for the material being pushed toward the center.

Figure 14A:
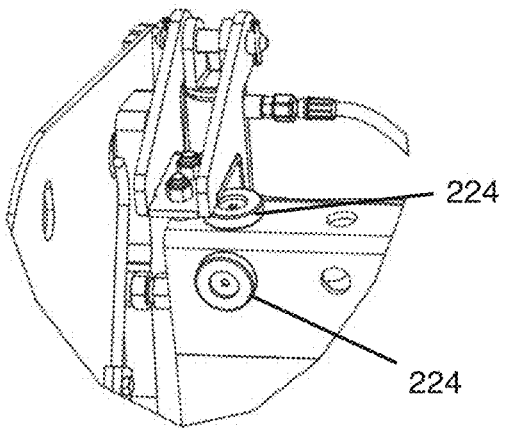
FIGS. 14A and 14B are perspective views of sub-sections of the extension blades according to sub-section identification on FIGS. 6 and 13.
Figure 14B:
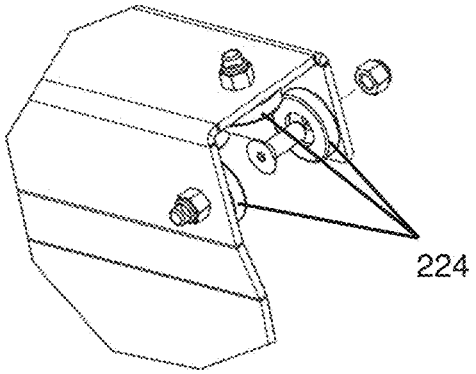
Figure 15:
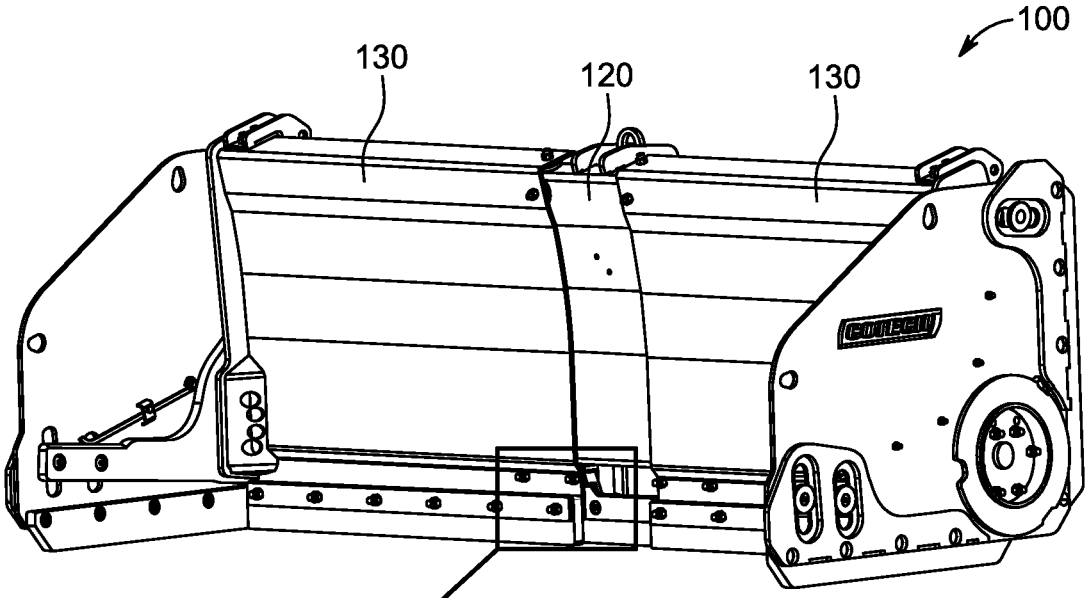
FIG. 15 is a perspective view of the front of the blade assembly of FIG. 1.
Figure 16:
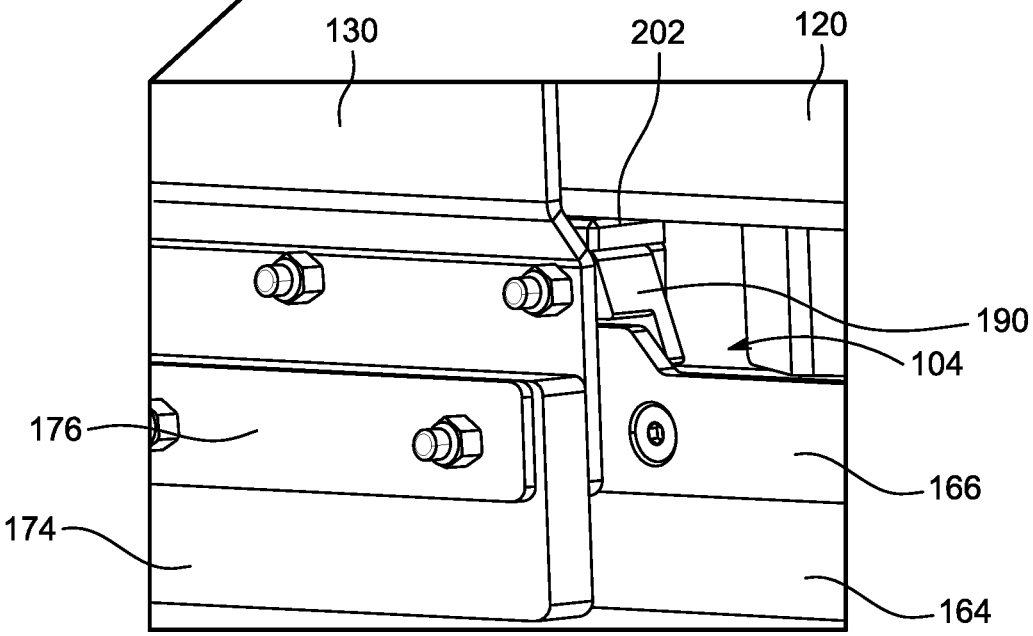
FIG. 16 is a close-up perspective view of a sub-section of the blade assembly according to the sub-section identification of FIG. 15.

Referring to FIGS. 14A and 14B, the blade assembly 100 comprises abutments 224 to limit the displacement of the extension blades 130 within the scope between the narrow configuration (i.e., retracted position) and the widest configuration (i.e., extended position) in addition to hydraulic systems controls.

Figure 19:
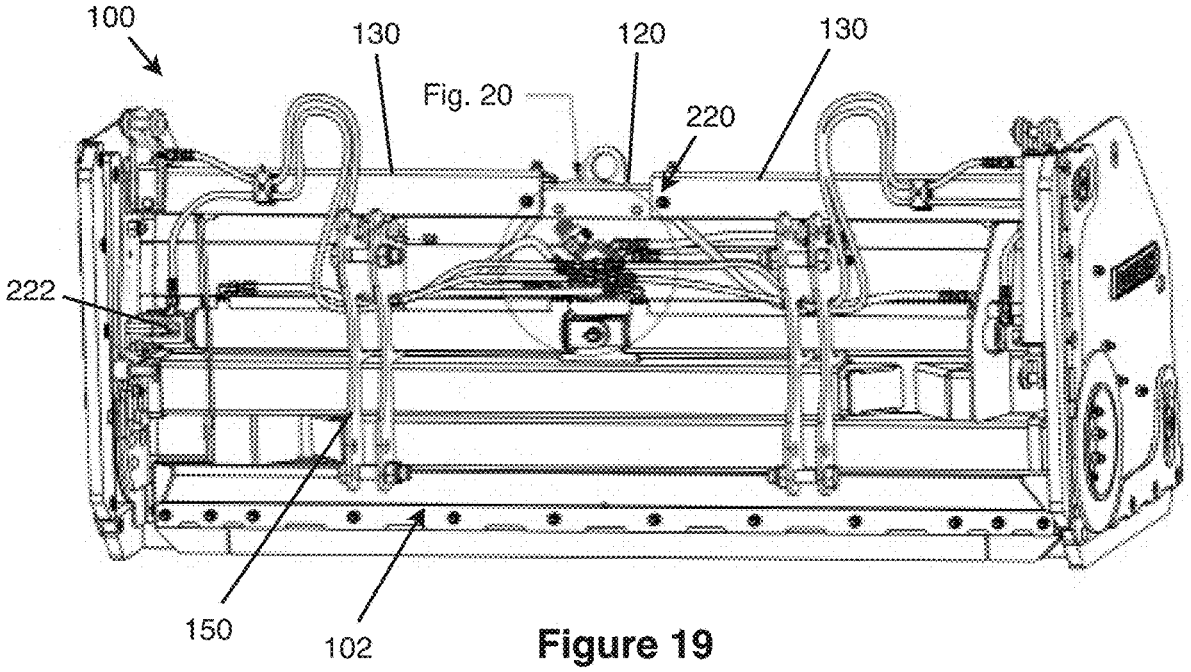
FIG. 19 is a perspective view of the rear face of the blade assembly of FIG. 1 with all components of the hydraulic system installed.
Figure 20:
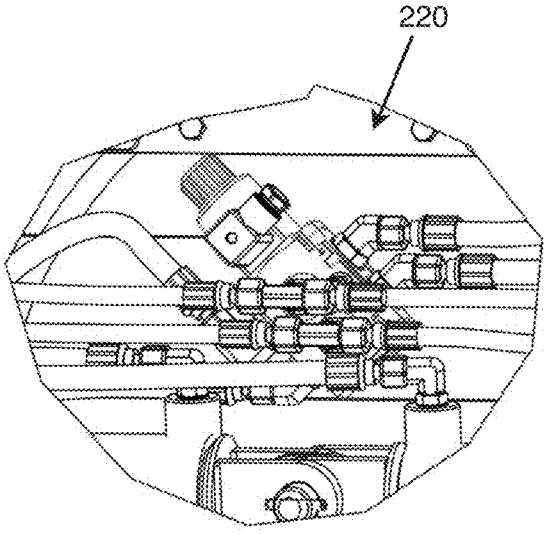
FIG. 20 is a perspective view of the sub-section of the blade assembly according to sub-section identification on FIG. 19.

Referring to FIGS. 19 and 20, the width of the blade assembly 100 is driven by a hydraulic system 220 connected to the vehicle hydraulic system (not depicted) of the snow plow. The hydraulic system 220, by actuating hydraulic pistons 222, displaces the extension blades 130 toward or away from the main blade 120, with the main blade 120 remaining stationary well mounted to the snow plow. The hydraulic system 220 is further configured to simultaneously displace inwardly or outwardly the extension blades, keeping the blade assembly 100 symmetric relative to the center line C-C and thus limiting unbalanced force the snow play may undergo when pushing material.

It is worth noting that that the bottom edge 124 of the main blade 120, thus the bottom of the main scraper blade 162, and the bottom edges 134 of the extension blades 130, the bottom of the extension scraper blades 172 extend substantially in the same plane; that is, they touch the ground about at the same time, and when contacting the ground they provide a continuous wall to push material.

Figure 17:
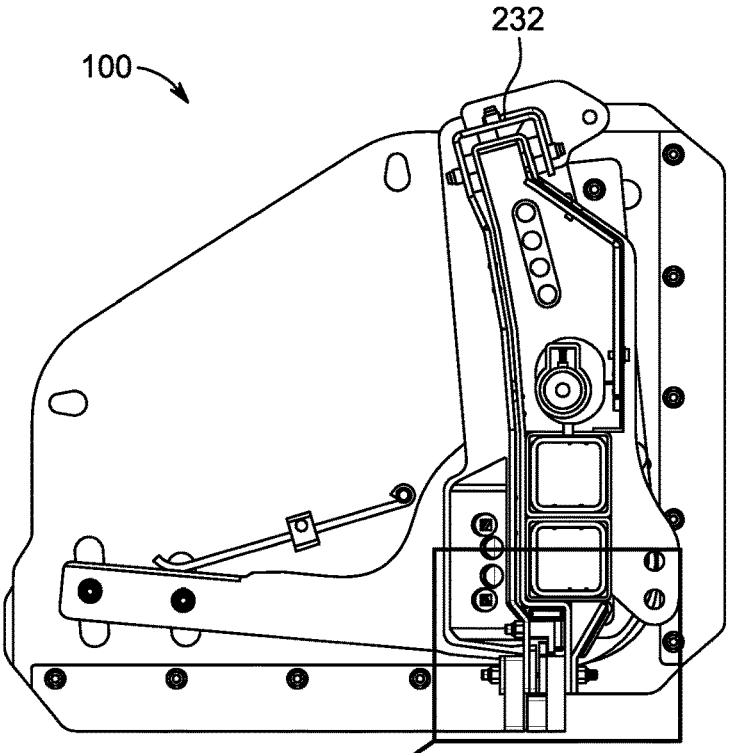
FIG. 17 is a cross-section view of the side of the blade assembly along center line C-C of FIG. 3.

Referring particularly to FIGS. 17 and 18, according to another perspective, the extension blade 130 comprises a top groove 232 interfacing with the top edge 122 of the main blade 120, and a bottom groove 234, parallel to the top groove 232, interfacing with the straight bar 166, a bar-shaped extension of the main blade 120. The top groove 232 and the bottom groove 234 limit the movements of the extension blade 130 relative to the main blade 120 to movements parallel to the axis of the grooves 232, 234. Glide pads 202, 204 and 208 are mounted to either one of the main blade 120 and the extension blade 130, directly or indirectly (e.g., on the slide member 190 mounted to the extension blade 130), to facilitate the displacement of the extension blade 130 relative to the main blade 120 and to fill gaps between the main blade 120 and the extension blade 130 thereby limiting relative movement between the main blade 120 and the extension blade 130. This solution comprises two grooves 232, 234 that ensure the interfacing and cooperation of the main blade 120 and the extension blades 130 while allowing the operator to control the width of the blade assembly 100.

Furthermore, the shape of the main blade 120 provides a ceiling area 240 interfacing with a horizontal area 242, the top face of the glide pad 202, mounted through the slide member 190 to the rear wall 116 of the extension blades 130. The ceiling area 240 prevents any upward movement of the extension blades 130 relative to the main blade 120. The combination of the grooves 232, 234 interfacing with the main blade 120 and the ceiling area 240 interfacing with the horizontal area 242 successfully fills the gaps between the main blade 120 and the extension blades 130 as to limit movements relative to each other, or in other words avoiding vertical movements and forward/backward movements while allowing movements parallel to the axes of the grooves 232, 234.

In a similar fashion, the shape of the main blade 120 provides a block area 244 interfacing with a vertical area 246, the rear face of the glide pad 204, mounted through the slide member 190 to the rear wall 116 of the extension blades 130. The block area 244 prevents any rearward movement of the extension blades 130 relative to the main blade 120.

The constraints combined of the ceiling area 240 and the block area 244 participate in providing limitations to movements of the extension blades 130 relative to the main blade 120 along the orientation of the grooves 232, 234, with the gaps in the interface between the main blade 120 and the extension blades 130 being filled with the glide pads 202, 204.

Furthermore, the position of the bottom groove 234 close to the bottom edges 124, 134 (see FIG. 5) of the blade assembly 100 limits the area on which the forces applied by the displaced material and the ground may operate on the blade assembly 100, thereby increasing its robustness.

It is worth noting that even though most of the components depicted on the figures are depicted with respect to the same scale when on a same figure, in some figures, gaps and spaces between the components may be exaggerated for teaching purposes. The blade assembly 100 of the present document aims to limit the gaps in the interface between the main blade 120 and the extension blades 130. Therefore, some gaps illustrated are out of scale, since practically non existing, and therefore should not be visible but are kept visible for teaching purposes.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A snow plow blade assembly for plowing material on a ground in a plowing direction, the snow plow blade assembly comprising:

a main blade extending perpendicularly to the plowing direction;

an extension blade extending laterally from the main blade;

an interface between the main blade and the extension blade near the ground;

a slide member mounted to the extension blade and comprising a groove; and a straight bar mounted to the main blade;

wherein the slide member and the straight bar are at the interface, wherein the main blade comprises a ceiling area extending horizontally at the interface;

wherein the slide member further comprises an outer top face extending horizontally; and wherein the groove of the slide member slidably cooperates with the straight bar as the main blade and the extension blade move relative to each other perpendicularly to the plowing direction and further wherein the outer top face of the slide member and the ceiling area of the main blade cooperate to hinder vertical movement of the extension blade relative to the main blade.

2. The snow plow blade of claim 1, wherein the main blade comprises a longitudinal bottom edge and the extension blade comprises a longitudinal bottom edge and further wherein the interface is at the longitudinal bottom edges; whereby the slidable cooperation of the slide member with the straight bar contributes to at least one of: a reduction of vibration of the main blade and the extension blade during operation; an increase in a rigidity of the assembly of the main blade and the extension blade; a reduction of a gap between the main blade and the extension blade at the interface; and a reduction of an accumulation of material in or to the blade assembly.

3. The snow plow blade assembly of claim 1, wherein the slide member is installed on the extension blade and the straight bar is installed on the main blade.

4. The snow plow blade assembly of claim 1, wherein the main blade has a longitudinal bottom edge, and wherein the snow plow blade assembly comprises a main scraper blade extending from the longitudinal bottom edge of the main blade with the straight bar and the main scraper blade being mounted together to the main blade.

5. The snow plow blade assembly of claim 1, further comprising a main scraper blade and an extension scraper blade, wherein the main blade and the extension blade each respectively comprise a longitudinal bottom edge, wherein the main scraper blade extends from the longitudinal bottom edge of the main blade and the extension scraper blade extends from the longitudinal bottom edge of the extension blade.

6. The snow plow blade assembly of claim 5, further comprising a glide pad installed between the main scraper blade and the extension scraper blade, the glide pad limits a clearance between a first rubber blade mounted to the extension blade and a second rubber blade mounted to the main blade.

7. The snow plow blade assembly of claim 6, wherein the glide pad is attached to the main scraper blade and wherein the glide pad extends from the second rubber blade below the extension blade.

8. The snow plow blade assembly of claim 1, wherein the main blade comprises holder assemblies for mounting the snow plow blade assembly to a snow plow, with the main blade being stationary and the extension blade being mobile with respect to the snow plow.

9. The snow plow blade assembly of claim 1, wherein the main blade further comprises a block area extending vertically from the ceiling area and the slide member further comprises an outer rear face extending vertically, wherein the block area and the outer rear face cooperate to hinder horizontal movement of the extension blade relative to the main blade.

10. The snow plow blade assembly of claim 9, wherein the straight blade comprises straight blade bottom edge, and wherein the main blade has a longitudinal bottom edge which extends vertically downwardly at least as far as the straight blade straight blade bottom edge.

11. The snow plow blade assembly of claim 9, wherein a gap exists between the main blade and the extension blade at the interface, the snow plow blade assembly further comprising a glide pad installed in the gap to reduce and to further minimize the gap between the main blade and the extension blade at the interface.

12. The snow plow blade assembly of claim 11, wherein the glide pad is installed between the slide member and the main blade.

13. The snow plow blade assembly of claim 11, wherein the slide member comprises an extension lip which cooperates with the straight bar to minimize the gap between the main blade and the extension blade at the interface.

14. The snow plow blade assembly of claim 13, wherein the slide member is L-shaped.

15. The snow plow blade assembly of claim 13, wherein the straight bar comprises a top edge, wherein the slide member is installed on the extension blade above the top edge with the extension lip extending beyond and below the top edge and distant from the extension blade to minimize relative movement of the straight bar between the extension blade and the slide member.

* * * * *